United States Patent [19]

Arashi

[11] Patent Number: 4,489,575

[45] Date of Patent: Dec. 25, 1984

[54] JET DYEING APPARATUS

[75] Inventor: Masahiro Arashi, Komatsu, Japan

[73] Assignees: Komatsu Seiren Co., Ltd.; Onomori Iron Works Co., Ltd., both of Ishikawa, Japan

[21] Appl. No.: 573,949

[22] Filed: Jan. 26, 1984

Related U.S. Application Data

[63] Continuation-in-part of Ser. No. 346,007, Feb. 5, 1982, abandoned.

[30] Foreign Application Priority Data

Jul. 1, 1981 [JP] Japan ..... 56-101252

[51] Int. Cl.[3] ..... D06B 3/28

[52] U.S. Cl. ..... 68/177; 68/184

[58] Field of Search ..... 68/177, 178, 184

[56] References Cited

U.S. PATENT DOCUMENTS 4,019,351 4/1977 Mizutani et al. ..... 68/177

4,210,005 7/1980 Trullas ..... 68/177 X

FOREIGN PATENT DOCUMENTS 2714801 12/1977 Fed. Rep. of Germany ..... 68/177

2910484 9/1980 Fed. Rep. of Germany ..... 68/177

*Primary Examiner*—Philip R. Coe

*Attorney, Agent, or Firm*—Robert E. Burns; Emmanuel J. Lobato; Bruce L. Adams

[57] ABSTRACT

A jet dyeing apparatus comprises a generally horizontal cylindrical high-pressure dyeing vessel having an outlet for a fabric standing portion at a front portion thereof, wherein the vessel is tilted slightly downward toward the direction of the front outlet, a liquid pan is provided at the lowest portion, a standing portion for the fabric is formed by a perforated pipe in the vessel in parallel therewith or being further tilted slightly downward toward the direction of the outlet so that the fabric and the dye liquor will smoothly flow therethrough while separated from each other. A circulation path for the fabric is formed by a liquor-injection portion and a transfer pipe installed on the upper side, and the dye liquor is circulated from the liquor pan into the liquor-injection portion by a circulation pump through a heat exchanger.

8 Claims, 4 Drawing Figures

JET DYEING APPARATUS

CROSS-REFERENCE TO RELATED APPLICATION

This is a continuation-in-part of application Ser. No. 346,007, filed on Feb. 5, 1982, now abandoned.

BACKGROUND OF THE INVENTION

The present invention relates to a low good-to-liquor ratio high-pressure jet dyeing apparatus. More specifically, the invention relates to a high-pressure jet dyeing apparatus, for circulating fabric in continuous length (for knitted, woven and other textile products) along with the dye liquor, which can continuously move the fabric at high speeds, under small tension, and at low goods-to-liquor ratios without such problems as outrunning and tangling.

Most conventional jet dyeing apparatus have adopted a construction which moves the fabric in continuous length through the liquor of the dyeing vessel in an alternate start-stop snake-like manner. The fabric therefore would often float free in the liquor, giving rise to outrunning and tangling and making it difficult to move the fabric smoothly and continuously. Further, any attempted reduction of the amount of the dye liquor relative to the fabric (goods-to-liquor ratio) would make it difficult to move the fabric through the standing portion and would result in an insufficient supply of the liquor to the circulation pump supplying the dye liquor to the liquor injection portion, thereby often interrupting operation. Still further, the fact that the fabric had stood in a considerable amount of the liquor meant that it was soaked with large amounts of the dye liquor, resulting in excessive tension imparted to the fabric when pulled up out of the liquor, this being one of the factors reducing the quality of the textile product.

SUMMARY OF THE INVENTION

To solve the above-mentioned problems, the present inventors have conducted studies showing that by the insertion of a specially perforated pipe inside a laterally-placed cylindrical high-pressure dyeing vessel so as to comprise tha standing portion of the fabric and to form a double construction and by the slight tilting of the vessel and placement of a liquor pan at the vessel lowermost portion, one can achieve operation at low goods-to-liquor ratios and conserve energy.

According to the present invention, there is provided a low goods-to-liquor ratio high-pressure jet dyeing apparatus which comprises a laterally-placed cylindrical high-pressure dyeing vessel having an outlet for the fabric standing portion at the front thereof, wherein the vessel is tilted slightly downward toward the direction of said outlet; a liquid pan is provided at the lowest portion; a standing portion for the fabric is formed by a perforated pipe in the vessel in parallel therewith or being further tilted slightly downward toward the direction of the outlet so that the fabric and a dye liquor will smoothly flow therethrough while separated from each other; a circulation path for the fabric is formed by a liquor-injection portion and a transfer pipe installed on the upper side; and the dye liquor is circulated from the liquor pan to the liquor-injection portion by a circulation pump through a heat exchanger.

DESCRIPTION OF PREFERRED EMBODIMENTS

Figure 1:
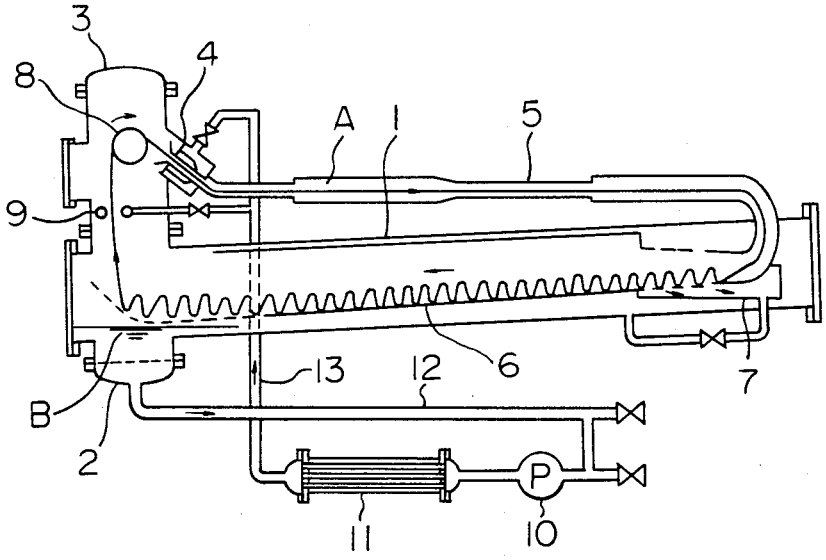
FIGS. 1 and 2 are diagrams schematically illustrating the apparatus of the present invention.

In FIG. 1, a standing portion 6 consisting of a special perforated pipe is inserted in a cylindrical dyeing vessel 1, thereby forming a double construction. The cylindrical dyeing vessel 1 is inclined or tilted by 1° to 4° downward toward the direction of the front outlet, and a liquor pan or reservoir 2 is provided at the lowest portion of the vessel. A rotary reel 8 for feeding the fabric is provided on the upper side of the outlet of the standing portion 6, a liquor-injection portion 4 is provided in a tangential direction relative to the reel, a transfer pipe 5 is arrayed, and an end of the transfer pipe is connected to the inlet of the standing portion 6. Further, a dye liquor-adjusting unit 7 is provided at the inlet portion of the standing portion 6 in order to adjust the flow rate and flow speed of the dye liquor introduced from the transfer pipe 5 depending upon the type and amount of the fabric to be dyed.

The cross-sectional shape of the standing portion 6 is not critical, but may preferably be in a circular shape having a diameter of 300 to 700 mm or in a rectangular or square shape having a side length of 300 to 700 mm. The transfer pipe 5 may preferably have a circular cross-sectional shape of a diameter of 80 to 160 mm or a rectangular or square cross-sectional shape of a side length of 80 to 160 mm.

Figure 2:
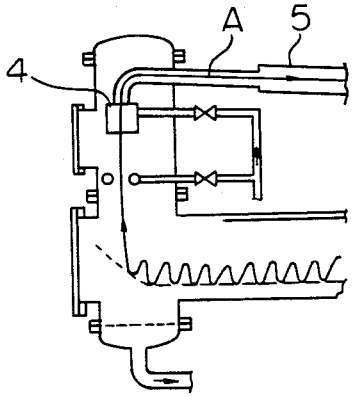

The dye liquor B is separated from the fabric in the dye liquor-adjusting unit 7 and in the standing portion 6, is allowed to flow into the liquor pan 2, is sent to the liquor-injection portion 4 by a circulation pump 10 being heated or cooled to a desired temparature through a heat exchanger 11, and is injected into the transfer pipe 5. The fabric A to be dyed is separated from the dye liquor at the outlet of standing portion 6, raised to the liquor-injection portion 4 via the rotary reel 8, and is released into the transfer pipe 5 together with a stream of dye liquor. In this case, the rotary reel 8 pulls up the fabric and changes its direction. The special perforated pipe employed in the present invention, however, solves such problems as outrunning and tangling, and only a small and constant power is required to pull up the fabric. As shown in FIG. 2, therefore, the fabric can be raised to the liquid-injector portion 4 and the direction of the fabric can be changed in the transfer pipe 5 even without a rotary reel.

Figure 3A:
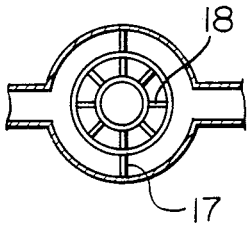
FIG. 3A is a vertical section view showing the liquor-injection portion on an enlarged scale.
Figure 3B:
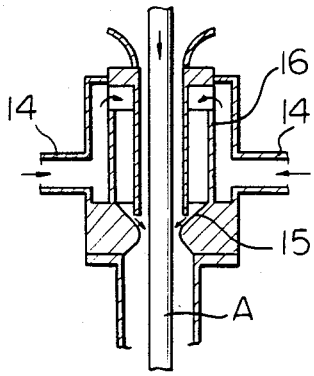
FIG. 3B is a lateral section view of the liquor-injection portion shown in FIG. 3A.

Conventional liquor-injection portions 4, generally formed circular in cross-section, suffer from the deflected current which often creates eddy currents twisting the fabric and consequently causing wrinkles and twist thereby reducing the quality of the textile products. With the liquor-injection portion 4 of the present invention, which is illustrated in detail in FIGS. 3A and 3B, however, a plurality of inlet ports 14 are formed at symmetrical positions and baffle boards 16 are provided inside the inlet ports to establish an overflow system. Furthermore, separator boards 17 and rectifier boards 18 are provided to prevent the development of any eddy current. The liquor-injection portion is not limited to one circular in cross-section and may be rectangular depending upon the type of fabric to be dyed.

The fabric and the dye liquor are brought into complete contact with each other in the liquor-injection portion 4 and in the transfer pipe 5, then are sent into the standing portion 6. In this case, the flow rate and the flow speed are adjusted at the inlet portion of the standing portion. That is, the fabric is orderly and smoothly moved toward the outlet. Here, the transfer pipe 5 may be tilted within ±5°, perferably upwardly tilted 0° to 2°. Furthermore, the cross-sectional shape of the transfer pipe may be changed one or more times at intermediate positions thereof to bring the fabric and the dye liquor into perfect contact, and to change the positions of the wrinkles of the continuous length fabric.

The standing portion 6 is tilted downward toward the direction of the outlet at an angle of 0° to 10°, preferably 2° to 5°.

In the illustrated embodiment, the perforated pipe comprising the standing portion 6 is perforated at the inlet and outlet ends thereof, and the middle portion of the perforated pipe between the inlet and outlet ends is free of perforations. In this case, the perforations at the inlet end have a diameter of 3 to 5 mm and are disosed spaced 6 to 15 mm, and the perforations at the outlet end have a diameter of 4 to 5 mm and are disposed spaced 8 to 10 mm. These perforations may be disposed in a staggered or regular arrangement at both ends. By the constitution of the perforated pipe, at the inlet end, excessive dye liquor is drained off into the dyeing vessel from the fabric traveling through the perforated pipe while sufficient dye liquor is retained in the perforated pipe effective to lubricate the fabric traveling axially through the perforated pipe. On the other hand, at the outlet end, some of the retained dye liquor is drained off into the dyeing vessel from the traveling fabric.

The standing portion 6 should preferably have a bottom flat in cross-section, however, no particular limitation is imposed in the shape. The standing portion and the vessel should form a double construction, so that the fabric and the dye liquor are moved separated from each other and so that the dyeing can be effected at a low goods-to-liquor ratio of about 1:5.

I claim:

1. A jet dyeing apparatus, comprising:

a high-pressure cylindrical dyeing vessel having an inlet end and an outlet end, wherein said cylindrical dyeing vessel is oriented generally horizontal with a slight downward inclination in the direction of said outlet end;

a perforated pipe within said cylindrical dyeing vessel extending away from said cylindrical vessel inlet end toward said cylindrical vessel outlet end with a slight downward inclination in the direction of said cylindrical vessel outlet end at least equal to the downward inclination of said cylindrical dyeing vessel, said perforated pipe defining a path for dye liquor and axial travel of a fabric to be dyed therein, said perforated pipe having an inlet end adjacent said cylindricl vessel inlet end with said perforated pipe inlet end having drain perforations dimensioned with diameters in the range of 3 to 5 millimeters and disposed spaced 6 to 15 millimeters and an outlet end adjacent said cylindrical vessel outlet end with said perforated pipe outlet end having drain perforations dimensioned with diameters in the range of 4 to 5 millimeters and disposed spaced 8 to 10 millimeters and being free of perforations at a middle portion of the perforated pipe defined between the inlet and outlet ends of said perforated pipe so as to be effective to drain off at said perforated pipe inlet end into said dyeing vessel excessive dye liquor from the fabric traveling therethrough while retaining sufficient dye liquor in said perforated pipe effective to lubricate the fabric traveling axially through said perforated pipe and so as to be effective to drain off at said perforated pipe outlet end into said dyeing vessel some of the retained dye liquor from the fabric traveling through the perforated pipe;

a dye liquor reservoir at said cylindrical vessel outlet end and positioned lower than said perforated pipe outlet end for receiving and retaining dye liquor flowing down said cylindrical dyeing vessel from said perforated pipe;

a dye liquor injector for supplying dye liquor to the fabric to be dyed;

a transfer conduit in communication with said perforated pipe for defining a path for fabric being dyed to travel from said dye liquor injector to said inlet end of said cylindrical dyeing vessel and into said perforated pipe; and dye liquor circulating means for circulating dye liquor from said dye liquor reservoir to said dye liquor injector.

2. An apparatus according to claim 1, wherein the inclination of the cylindrical dyeing vessel is 1° to 4°.

3. An apparatus according to claim 1, wherein the standing portion is inclined downward toward the direction of the outlet at an angle of 0° to 10°.

4. An apparatus according to claim 1, wherein the perforated pipe has a bottom flat in cross-section.

5. A jet dyeing apparatus according to claim 1, wherein said dye liquor circulating means includes a circulation pump and a heat exchanger.

6. A jet dyeing apparatus according to claim 1, wherein said perforated pipe is mounted stationary within said cylindrical dyeing vessel.

7. A jet dyeing apparatus according to claim 1, wherein the fabric to be dyed is raised from said outlet end of said perforated pipe to the dye liquor injector via a rotary reel.

8. A jet dyeing apparatus according to claim 1, wherein the fabric to be dyed is raised from said outlet end of said perforated pipe directly to the dye liquor injector.

* * * * *